US005534903A

United States Patent [19]

Hayakawa et al.

[11] Patent Number: 5,534,903

[45] Date of Patent: Jul. 9, 1996

[54] INK JET HEAD

[75] Inventors: Tsuyoshi Hayakawa; Hajime Oda; Takashi Kogo; Yukiharu Shimizu; Shoichi Sato; Toshiya Tamura; Hiroyuki Kojima, all of Chiba-ken, Japan

[73] Assignee: Seikosha Co., Ltd., Tokyo, Japan

[21] Appl. No.: 93,281

[22] Filed: Jul. 16, 1993

[30] Foreign Application Priority Data

Jul. 20, 1992 [JP] Japan ..... 4-192290

[51] Int. Cl.[6] ..... B41T 2/045

[52] U.S. Cl. ..... 347/71

[58] Field of Search ..... 346/140 R; 347/40, 347/47, 71, 87, 70, 20, 44; B41J 2/045

[56] References Cited

U.S. PATENT DOCUMENTS 5,157,420 10/1992 Naka et al. ..... 347/71 X

FOREIGN PATENT DOCUMENTS 55-137975 10/1980 Japan .
63-5951 1/1988 Japan ..... 347/47
3-118159 5/1991 Japan ..... B41J 2/045
3-295657 12/1991 Japan ..... B41J 2/045

*Primary Examiner*—Benjamin R. Fuller
*Assistant Examiner*—Alrick Bobb
*Attorney, Agent, or Firm*—Amster, Rothstein & Ebenstein

[57] ABSTRACT

An ink jet head includes a nozzle plate having a nozzle through the nozzle plate in its thickness direction, a base plate laminated with the nozzle plate and having an ink supplying hole through the base plate in its thickness direction, a pressure chamber connected to the nozzle and the ink supplying hole in the substantially perpendicular manner and provided with a pressure means on the bonded surface of the nozzle plate and the base plate. The nozzle and the ink supplying hole are made narrower than the pressure chamber and the connecting channel. The plural nozzles, pressure chambers, connecting channels, and ink supplying holes are provided. A common ink chamber connecting to a plurality of the ink supplying holes are provided on the opposite surface to the nozzle plate laminated with the base plate in the perpendicular manner to the nozzle plate. A projection is formed in the nozzle plate and the nozzle is provided through the projection. The ink head enables to prevent bonding materials from flowing into the thin portions during bonding process, to eliminate variations in efficiency of ink ejection at the respective nozzles, and to improve the printing finish in quality.

2 Claims, 2 Drawing Sheets

INK JET HEAD

BACKGROUND OF THE INVENTION

This invention relates to an on-demand type ink jet head in which ink is ejected from a nozzle for printing.

Conventionally, in the Japanese Laid-Open Patent Publication No. 60(85)-129263, a common ink chamber is formed on an upper surface of a base plate and connected to each pressure chamber through a plurality of ink supplying channels. Each pressure chamber is connected to an associated nozzle through a connecting channel and the components from the common ink chamber up to the respective connecting channels are formed in one plate. Each nozzle is provided at an extremity of the associated channel in a direction perpendicular to the connecting channel. In a vibrating plate bonded to the passage base plate, an ink ejecting means such as a piezoelectric element is provided at the corresponding position to the pressure chamber. The ink supplying channels and the connecting channels in the vicinity of the nozzle are narrower than other portions.

In the case where the vibrating plate is bonded to the passage base plate, it is conventional to bond them together with adhesive agents. However, this suffers from clogging troubles of adhesive agents in narrow portions such as ink supplying channels and connecting channels in the vicinity of the nozzle. Accordingly, instead of adhesive agents, solvents or dope cements are sometimes used. In this case, however, some solvents or dope cements would flow into the channels, thereby changing the ejection characteristics of the ink droplets, resulting in remarkable variation in flow resistance of channels. In the end, this leads to the variation in efficiency of ink ejection of the respective nozzles. Specifically, the narrow portions such as the ink supplying channels and the connecting channels would largely affect the ink ejection characteristics. Accordingly, unless the narrow portions are formed with high precision, the printing quality would be remarkable degraded.

SUMMARY OF THE INVENTION

It is an object of the invention to stop flowing adhesive agents, solvents, and dope cements into the thin portions, to reduce the variation in efficiency of the respective nozzles to a negligible extent, and to attain the improvement in printing quality.

In order to accomplish the above object, in a ink jet head of the present invention, a nozzle plate having a nozzle and a base plate having an ink supplying hole are laminated. On the laminated surface of the nozzle plate and the base plate, a pressure chamber is connected substantially perpendicular to the nozzle and the ink supplying hole and provided with a pressure means. Connecting channels an formed to connect the pressure chamber to the nozzle and the ink supplying hole. The nozzle and the ink supplying hole are narrow than the pressure chamber and the connecting channel.

A plurality of nozzles, pressure chambers, connecting channels, and ink supplying holes are provided, and a common ink chamber connected to a plurality of ink supplying holes is also provided in the opposite surface to the nozzle plate bonded with the base plate perpendicular to the ink supplying hole. Further, a projection is provided in the nozzle plate, and the nozzle is extended from the projection.

As the nozzle and the ink supplying hole narrower than the connecting channel are formed through the nozzle plate in the direction of its thickness, the adhesive agent or bonding material is prevented from flowing into the narrow portions when the nozzle plate is laminated with the base plate. The ink ejection characteristic becomes stable because the thin portions greatly influenced in flow resistance are exactly formed with the desired structure.

DESCRIPTION OF THE PREFERRED EMBODIMENTS

Figure 1:
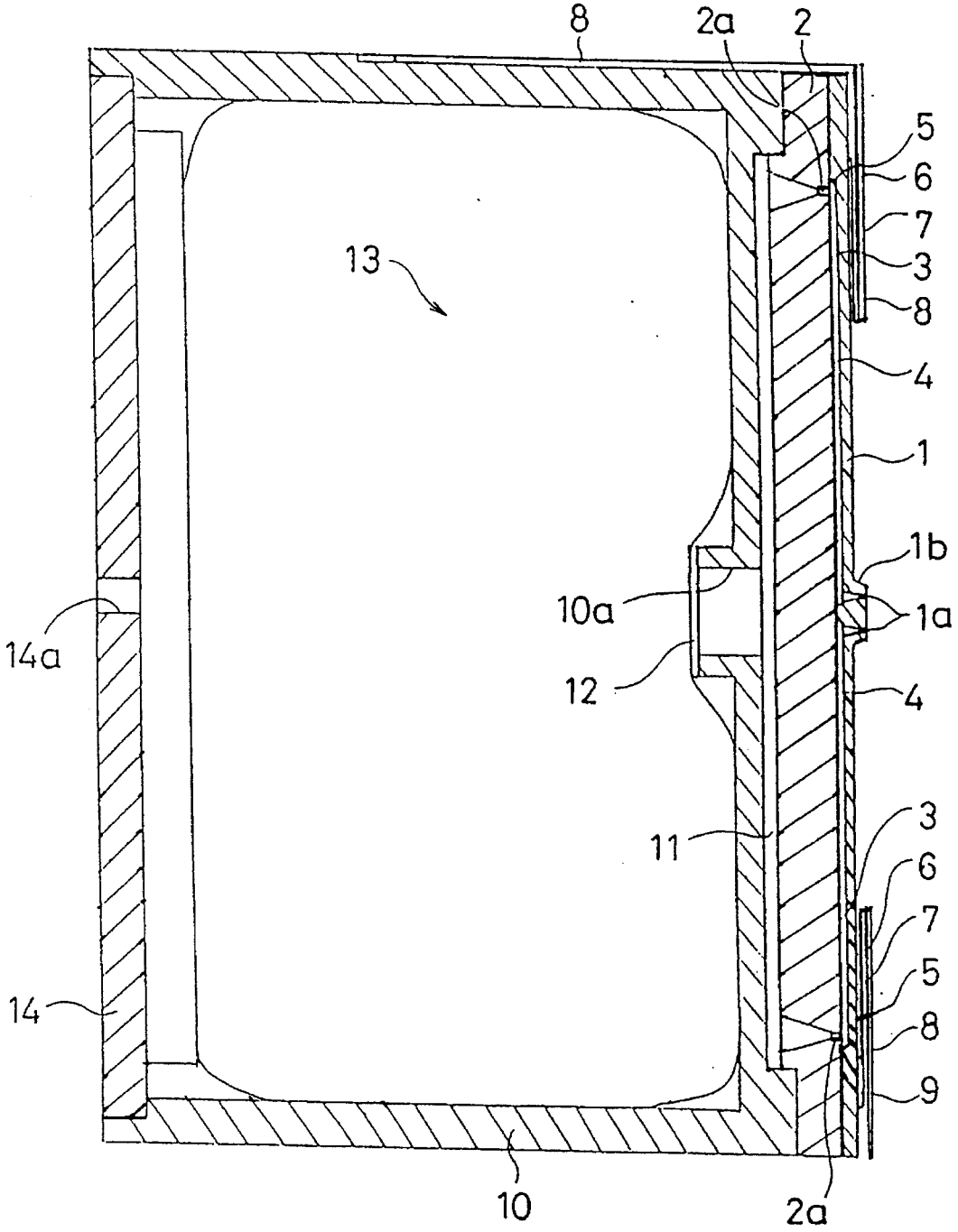
FIG. 1 is a cross-sectional view showing a head according to an embodiment of the present invention.
Figure 2:
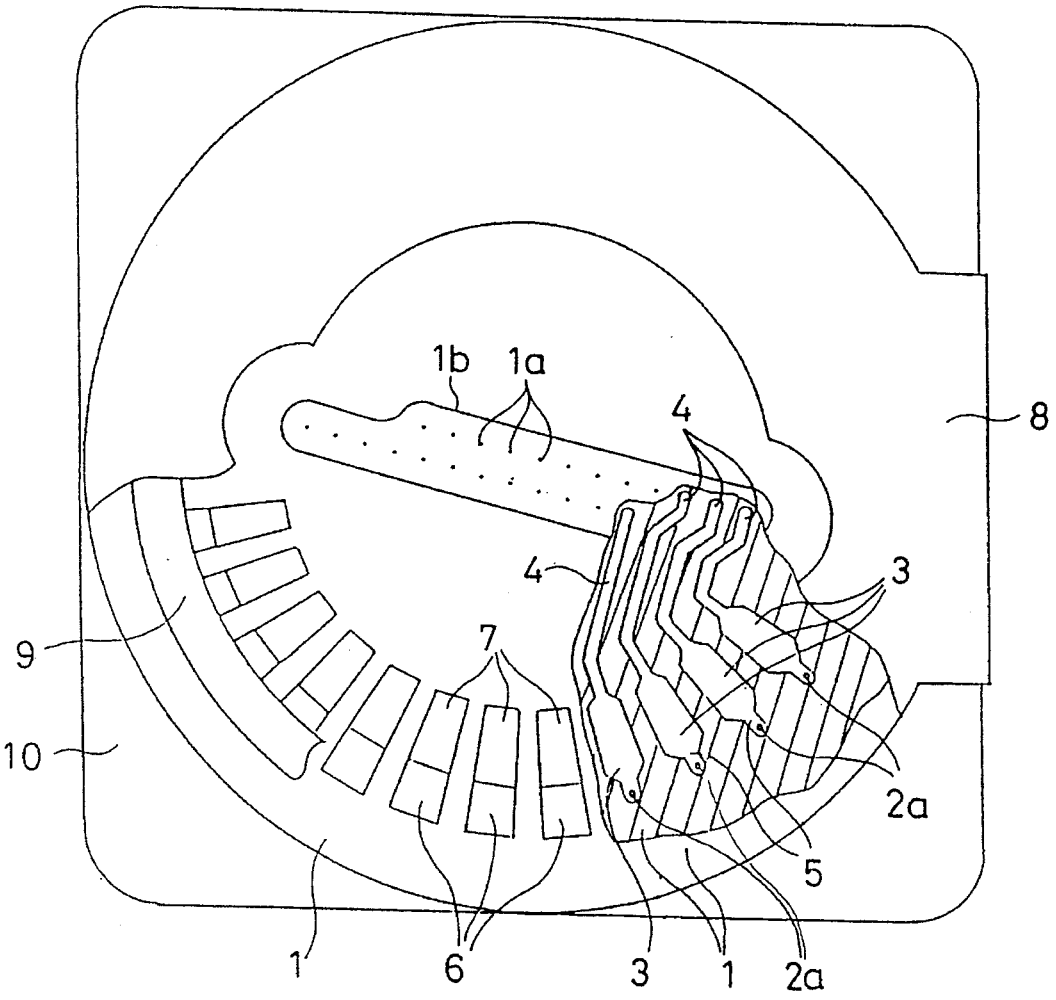
FIG. 2 is a partially fragmentary front view of the head shown in FIG. 1.

One embodiment of the invention will now be explained in reference to FIGS. 1 and 2. A nozzle plate 1 is made of material such as polysulfone which is chemically resistant against ink and suitable for bonding or gluing. A plurality of nozzles 1*a* are formed through the nozzle plate 1 in a direction of its thickness. As illustrated, a projection 1*b* is formed on a front face at a center of the nozzle plate 1, and the nozzles 1*a* is formed to penetrate the projection 1*b*. A base plate 2 is laminated and bonded to a back surface of the nozzle plate 1. A plurality of ink supplying holes 2*a* are formed to penetrate the base plate 2 in the direction of its thickness. On the bonding surface of the nozzle plate 1 with the base plate 2, a plurality of pressure chambers 3 are provided substantially perpendicular to the nozzles 1*a* and the ink supplying holes 2*a*. Connecting channels 4 and 5 are partitioned so as to make each pressure chamber 3 communicate with the associated nozzle 1*a* and ink supplying hole 2*a*. The nozzle 1*a* is opened to the connecting channel 4, whereas the ink supplying hole 2*a* is opened to the connecting channel 5.

The nozzles 1*a* and the ink supplying holes 2*a* are narrower than the pressure chamber 3 and the connecting channels 4 and 5. As a result, flow resistances in the nozzles 1*a* and the ink supplying holes 2*a* are larger than those of the pressure chamber 3 and the connecting channels 4 and 5. It is desirable to form the nozzles 1*a* with their flow resistances smaller than or substantially equal to those in the ink supplying holes 2*a*.

A pressure means is provided in front of the nozzle plate 1 and opposite the pressure chamber 3. More definitely, the pressure means is formed by laminating a plurality of piezoelectric elements 7 and a plurality of vibrating plates 6 made of phosphor bronze or brass and by bonding the piezoelectric elements 7 and the vibrating plates 6 to the nozzle plate 1 with adhesives such as epoxy resin. Each piezoelectric element 7 is bonded with conductive paste to an associated electrode of a flexible cable 8 in which a pattern electrode electrically connected to driver IC (not shown) for driving external piezoelectric elements is formed. A common electrode 9 is bonded to the front face of the nozzle plate 1 with adhesives such as conductive paste. The common electrode 9 is conductively connected to each vibrating plate 6 to which the associated piezoelectric element 7 is bonded. The electrode 9 is connected to the associated electrode of the flexible cable 8 with conductive paste.

An ink cartridge case 10 is bonded to the back surface of the base plate 2 with adhesives such as the epoxy resin. A common ink chamber 11 is provided between the base plate 2 and the cartridge case 10 so as to be perpendicular to and communicate with the ink supplying holes 2*a*. An opening

10*a* is formed at the center of the common ink chamber 11 to supply ink from the cartridge case 10, and a filter 12 is heat-bonded to the opening 10*a*. Thus, the dust contained in the ink in the cartridge case 10 are prevented from entering into the common ink chamber 11.

The ink in the cartridge case 10 is stored in an impregnant state in porous material such as polyurethane, and sealed by a cover 14 having an air vent 14*a*.

Upon forming the ink head with such an arrangement, no adhesive is flowed or entrained into the nozzles 1*a* and the ink supplying holes 2*a*, because the nozzles 1*a* and the ink supplying holes 2*a* with high flow resistance are provided away from the bonding portions. As illustrated in FIG. 2, only the pressure chambers 3 with large cross sections and the connecting channels 4 and 5 would suffers problems that the adhesive is entrained to hinder the precise formation thereof. The flow resistances mainly depend upon the shape of the narrow portion but not upon the shape of the wide portions. In other words, the flow resistance greatly varies even if small difference occurs in the shape of the thin portions such as the nozzles 1*a* and the ink supplying holes 2*a*, and no remarkable variations would not largely affect the flow resistance even if there is small difference in the shapes of the wide pressure chambers 4 and 5. Therefore, according to the present invention, the ink ejection characteristics are free of the entrainment of the adhesive into the narrow portions.

During ink ejection, a drive signal is transmitted to each piezoelectric element 7 from the drive IC through the flexible cable 8. Then, the the piezoelectric element 7 is deformed to bend the associated vibrating plate 6 toward the pressure chamber 3, thereby pressing the ink in the pressure chamber 3 to eject the ink from the nozzle 1*a*. Simultaneously, therewith the ink flows into the pressure chamber 3 from the common ink chamber 11 through the ink supplying hole 2*a*, and the amount of ink is determined by the flow resistance of both the nozzle 1*a* and the ink supplying hole 2*a*. As described above, a constant amount of the ink is ejected from the nozzle 1*a* when the flow resistance of the nozzle 1*a* is determined to be smaller than that of the ink supplying hole 2*a*. Owing to this pressure, the ink stored in the porous material is supplied to the pressure chamber 3 and the connecting channels 4 and 5 through the filter 12 and the ink common chamber 11.

In the illustrated embodiment, the ink supplying holes 2*a* are each formed in a single through-hole but, the holes 2*a* are not limited thereto. A plurality of through-holes (not shown) can be applied to form each of the ink supplying holes 2*a*. Thus, insufficient supply due to clogging in the holes can be avoided.

Further, it is possible to promote printing density by obliquely disposing the respective nozzles 1*a*, so as to concentrate the amount of ejected ink on the center portion.

As explained above, in the present invention, the narrow nozzles and ink supplying holes are provided through the nozzle plate and the base plate in the direction of their thicknesses, and, therefore, the adhesives, solvent, dope cement and the like are prevented from flowing into these thin nozzles and ink supplying holes and from adversely affecting the ink ejection characteristics of the nozzles. The variation in the ink ejection efficiency of the respective nozzles can be suppressed to a negligibly small extent, the printing result can be improved in quality, and the stable performance can be obtained as desired. Further, the ink jet head can be produced in the compact size because the common ink chamber is formed in the opposite surface to the nozzle plate bonded with the base plate, and the plate thickness in the portions other than the nozzles can be reduced so as to obtain high efficiency for the pressure means.

What is claimed is:

1. An ink jet head comprising:

(a) a nozzle plate provided with nozzles, (b) a base plate provided with ink supplying holes and having one surface laminated with a surface and said nozzle plate, (c) pressure chambers provided on at least one of said nozzle plate and said base plate, (d) pressure means provided on one of said nozzle plate and said base plate correspondingly to each of said pressure chambers for effective ejection of ink, (e) inner connecting channels provided between said nozzle plate and said base plate so as to connect each of said pressure chambers to each of said nozzles, (f) outer connecting channels provided between said nozzle plate and said base plate so as to connect each of said pressure chambers to each of said ink supplying holes, and (g) a common ink chamber connecting to said ink supplying holes so as to supply ink;

said head being characterized in that (i) said nozzles are bored in a thickness direction of said nozzle plate, (ii) said ink supplying holes are bored in a thickness direction of said base plate, (iii) said pressure chambers and said inner and outer connecting channels are recessed on a surface of at least one of said nozzle plate and said base plate and substantially perpendicular to said nozzles and said ink supplying holes, (iv) the diameter of said nozzles is smaller than a width of said inner connecting channels, (v) the diameter of said ink supply holes is smaller than a width of said outer connecting channels, (vi) said nozzle plate and said base plate are laminated to each other by adhesive applied outside of said pressure chambers and said inner and outer connecting channels, (vii) said common ink chamber is provided on a surface of said base plate which is opposite to the surface laminated to said base plate, and (viii) a direction of inkflow through said nozzles coincides with a direction of inkflow through said ink supplying holes.

2. An ink jet head according to claim 1 wherein projections are formed on a surface of said nozzle plate opposite to the surface laminated to said base plate, and said nozzles are provided through said projections.

* * * * *